US005249393A

United States Patent [19]

Judge et al.

[11] Patent Number: 5,249,393

[45] Date of Patent: Oct. 5, 1993

[54] BRAKE DRUM MICRO-FINISHING APPARATUS

[75] Inventors: Norman R. Judge, Dewitt; Edward E. Judge, Lansing, both of Mich.

[73] Assignee: Industrial Metal Products, Corp., Lansing, Mich.

[21] Appl. No.: 823,137

[22] Filed: Jan. 21, 1992

[51] Int. Cl.[5] ..... B24B 21/16; B24B 29/02

[52] U.S. Cl. ..... 51/141; 51/145 R; 51/142; 51/237 R

[58] Field of Search ..... 51/135 R, 141, 142, 51/357, 145 R, 143, 328, 237 R

[56] References Cited

U.S. PATENT DOCUMENTS

| | | | |
|---|---|---|---|
| 2,115,461 | 4/1938 | Hartmann | 51/34 C |
| 2,164,811 | 7/1939 | Floss | 51/34 D |
| 2,165,566 | 7/1939 | Meakin | 51/135 R |
| 2,313,442 | 3/1943 | Kline | 51/349 |
| 4,145,845 | 3/1979 | Ebelt | 51/34 F |
| 4,328,647 | 5/1982 | Gillette et al. | 51/338 |
| 4,462,189 | 7/1984 | Puybaraud | 51/338 |
| 4,601,133 | 7/1986 | Gebald et al. | 51/135 R |
| 4,643,055 | 2/1987 | Contoyonis | 51/237 R |
| 4,682,444 | 7/1987 | Judge et al. | 51/154 |
| 4,707,944 | 11/1987 | Parsons | 51/34 F |
| 4,858,265 | 8/1989 | Suzuki et al. | 51/135 R |
| 4,870,786 | 11/1989 | Millay et al. | 51/237 R |
| 4,951,422 | 8/1990 | Ibe et al. | 51/237 R |
| 4,993,190 | 2/1991 | Hiyoshi | 51/142 |
| 4,999,953 | 3/1991 | Kinugawa et al. | 51/143 |
| 5,109,632 | 5/1992 | Hostler | 51/142 |
| 5,148,639 | 9/1992 | Sakai | 51/142 |

FOREIGN PATENT DOCUMENTS

| | | | |
|---|---|---|---|
| 0878511 | 11/1981 | U.S.S.R. | 51/142 |

*Primary Examiner*—Bruce M. Kisliuk
*Assistant Examiner*—Bo Bounkong
*Attorney, Agent, or Firm*—Harness, Dickey & Pierce

[57] ABSTRACT

An apparatus for micro-finishing a brake drum braking surface. The invention uses a center of rotation gaged from the unfinished braking surface to properly position the brake drum on the apparatus and position a shoe for engagement with the braking surface A film, having an abrasive surface, is routed over the shoe so that the abrasive surface will contact the braking surface. The brake drum is rotated and the film is urged into contact with the braking surface while the film and the shoe are axially oscillated along the rotational axis of the brake drum. In mounting the brake drum on the micro-finishing apparatus, a mechanism is provided for simulating the mounting forces normally incurred by the brake drum during use.

34 Claims, 3 Drawing Sheets

BRAKE DRUM MICRO-FINISHING APPARATUS

BACKGROUND AND SUMMARY OF THE INVENTION

This invention relates to finishing brake drums and more particularly to an apparatus using an abrasive film to micro-finish the braking surface of a brake drum.

It is generally required that brake drums, as typically found on motor vehicles, have their braking surfaces finished prior to mounting onto a motor vehicle. Previously, the finishing of brake drums has been of two varieties.

One variety finishes the braking surface by drawing a single point tool across the braking surface as the brake drum is rotated. However, as the single point tool is drawn axially across the braking surface, the tool inevitably carves a helix into the braking surface. During actual use of a brake drum finished in this manner, the helix will operate as a "screw" when a brake shoe is applied against the braking surface and will axially draw the brake shoe along the helix generally out of the brake drum. When the applied pressure of the brake shoe is released, the mechanical linkages of the brake shoe abruptly pull the brake shoe back into its proper position. Often, a result of the brake shoe being brought back into its proper position is that the brake shoe strikes against other components of the brake system and induces unwanted mechanical shock, vibration and noise, also known as "brake slap". Additionally, the use and often replacement of single point tools is costly.

Another method used for finishing the braking surface substitutes a honing stone for the single point tool. The results, however, are not a substantial improvement. During the finishing of the braking surface, the honing stone is drawn across the rotating braking surface. The lead angle of the honing stone similarly causes a helical groove to be cut into the braking surface of the brake drum. The helix again operates to pull an applied brake shoe axially out of the brake drum which results in mechanical shock, vibration and brake slap once the brake shoe is released.

An additional aspect of the brake drum having a helix in the finish of its braking surface is that the surface roughness ($R_a$) of the finish is greater than that required for braking purposes. A smoother braking surface would increase the wear life of the drum lining and the braking material of the brake shoe.

Another limitation occurring in brake drums is a departure of the braking surface from true roundness (CG). This is partially a result of the finishing process not being utilized to geometrically alter the shape of the braking surface, but rather, solely being used to polish the braking surface. Thus, the degree to which the braking surface is cast "out-of-round" will not be corrected by the finishing process.

A further limitation often found in brake drums is that the braking surface, when viewed in cross section, is not straight and also exhibits a bore taper from the inboard portion of the braking surface, when compared against a reference axis drawn through the center rotation of the brake drum. As bore taper increases and straightness decreases, the brake shoe experiences twisting or only partial application against the braking surface. Preferably, the braking surface is straight and exhibits little or no taper.

Eccentricity of the braking surface, relative to the center of rotation of the brake drum, is also undesirable and results in uneven finishing of the braking surface and uneven wear of the brake pad and drum lining. During initial formation of a composite brake drum, eccentricity can result from a separate mounting plate being incorporated into a casting mold and the casting of the remaining portions of the brake drum thereonto.

With the above and other limitations in mind, it is an object of the present invention to provide a micro-finishing apparatus and method for micro-finishing the braking surface of a brake drum without the production of a helix in the finish of the braking surface. In this manner, the present invention seeks to eliminate the brake slap, vibration and mechanical shock which typically accompany the formation of a helix in the braking surface. By eliminating the helix, the present invention also seeks to decrease the surface roughness previously associated with brake drums.

An additional object of this invention is to permit the micro-finishing process to affect the geometry of the braking surface. In this manner the present invention aims to increase the roundness of the braking surface, increase its cross sectional straightness, and to decrease the bore taper of the braking surface.

Another object of the present invention is to decrease eccentricity existing between the braking surface and the center rotation of the brake drum itself. In achieving reduced eccentricity, the apparatus and method of the present invention seeks to gage the micro-finishing of the braking surface from a center rotation established by the braking surface.

It is also an object of this invention to simulate, during micro-finishing, the actual forces experienced by the brake drum when mounted onto a motor vehicle for use.

Still another object of this invention is to decrease the costs associated with finishing the brake drum braking surface.

In achieving the above objects, the present invention provides a micro-finishing apparatus and method for micro-finishing the inner cylindrical braking surface of a brake drum. A center of rotation is gaged from the braking surface and is used to establish the actual center of rotation for the brake drum. Thus eccentricity between the two is eliminated. The brake drum is mounted to the micro-finishing apparatus in a manner which simulates the forces experienced by the brake drum when actually mounted to a motor vehicle. The micro-finishing apparatus uses an arcuate tool or shoe having a surface which generally corresponds to the cylindrical braking surface of the brake drum. An abrasive film is supplied so as to be positioned over the surface of the shoe. During micro-finishing, relative movement is established between the abrasive film and the braking surface with the abrasive film and the shoe being urged against the braking surface of the brake drum. The abrasive film can also be advanced during the actual micro-finishing process to continually provide for the use of new or clean film. The apparatus is also provided with an assembly for oscillating the abrasive film relative to the braking surface.

In using the apparatus of the present invention, the micro-finishing process can be outlined as follows:

a) gaging a center of rotation for the brake drum off of the braking surface of the brake drum;

b) forming a mounting bore in the brake drum which is concentric with the center of rotation established by the braking surface;

c) locating the mounting bore of the brake drum on the micro-finishing apparatus so that a rotational axis of the micro-finishing apparatus will correspond with the center of rotation established by the braking surface;

d) securing the brake drum on the micro-finishing apparatus in a manner simulating the mounting forces experienced by the brake drum during actual use;

e) rotating the brake drum;

f) positioning an abrasive film over a surface of a finishing tool; and g) urging the abrasive film into contact with the braking surface to micro-finish the brake drum braking surface.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENT

Figure 1:
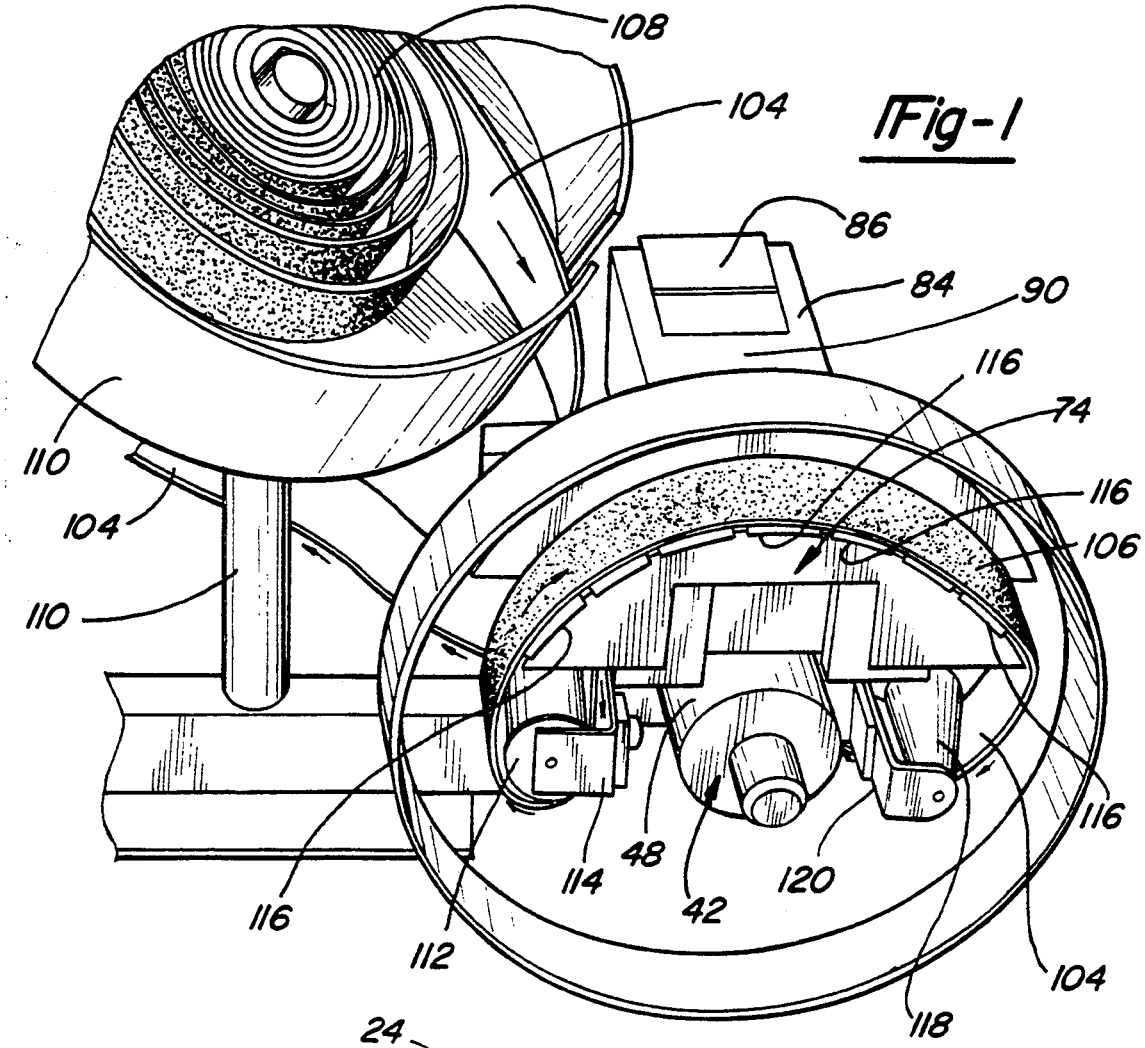
FIG. 1 is a perspective view of a portion of a micro-finishing apparatus incorporating the principles of the present invention and illustrates an abrasive film being positioned over a polishing tool.
Figure 2:
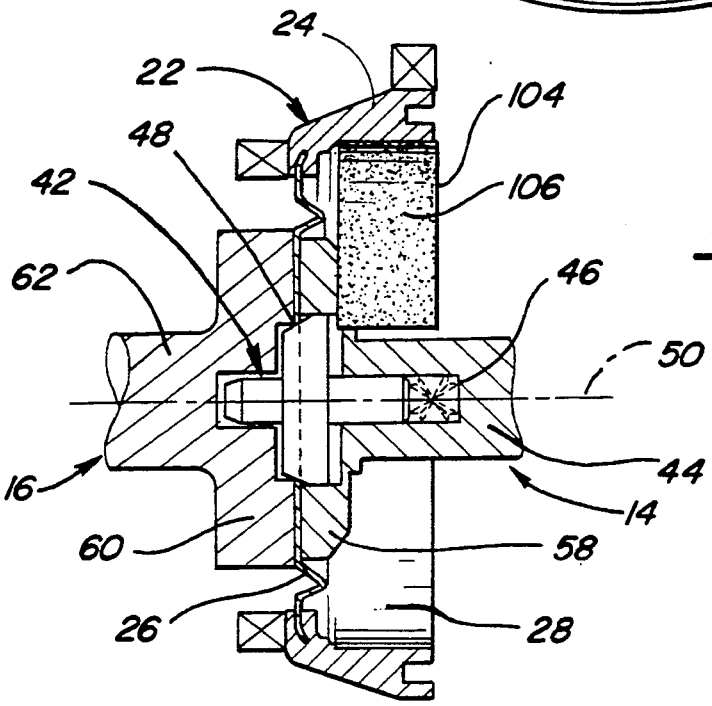
FIG. 2 is a cross-sectional view generally illustrating the mounting of a brake drum to the micro-finishing apparatus illustrated in FIG. 1.

Now with reference to the drawing, an apparatus for micro-finishing a brake drum braking surface is generally illustrated in the figures and designated at 10. The apparatus 10 itself may be broken down into its several components which include but are not limited to a gaging assembly 12, a mounting assembly 14, a rotation assembly 16, a shoe assembly 18, and an oscillation assembly 20. While the above assemblies are referred to as being distinct from one another, it is important to note that various elements of these assemblies are interrelated and perform functions which relate to more than one of the assemblies.

In the interest of clarity, it is believed that the brake drum micro-finishing apparatus 10 of the present invention will be most easily understood if it is described in relation to the method employed for micro-finishing the braking surface. This discussion will, therefore, generally proceed along those lines.

A common brake drum, as generally illustrated in the figures at 22, can be formed by a variety of methods. Perhaps the most common of these methods is the casting of a skirt or cylindrical portion 24 onto a preformed mounting or face plate 26. During the initial forming, the skirt 24 of the brake drum 22 is cast so as to include an interior braking surface 28. The braking surface 28 is a substantially cylindrical surface which extends continuously around the interior of the skirt 24. Unfortunately, the casting of the skirt 24 does not provide the brake drum 22 with all of its desired characteristics.

One characteristic which must be subsequently imparted to the brake drum 22 is that the roughness of the braking surface 28 must be decreased and finished. The apparatus 10 and method of the present invention are primarily directed to this characteristic. Another desired characteristic, the braking surface 28 being coaxial with the center of rotation of the brake drum 22, is not ensured by casting and often occurs as a result of the skirt 24 being cast onto the face plate 26. This characteristic is also given particular attention by the apparatus 10 and method of the present invention as more fully set out below.

As stated above, a problem, which often develops when the skirt 24 of the brake drum 22 is cast onto the face plate 26, is that the center of rotation defined by the braking surface 28 will differ from a center of rotation established by the face plate 26, more particularly a mounting bore 30 formed in the face plate 26. In finishing the braking surfaces 28 of brake drums 22, one philosophy has been that the finishing process itself should not alter the braking surface geometry. However, to align the center of rotation of the braking surface 28 with the center of rotation of the brake drum 22, as established by the mounting bore 30, such an altering of the braking surface geometry generally has to occur. The apparatus 10 and method of the present invention eliminate these differing centers of rotation by forming a new mounting bore 32 in the face plate 26 while gaging the new mounting bore's 32 position from the braking surface 28, thereby ensuring that the center of rotation of the new mounting bore 32 corresponds with that of the braking surface 28.

Figure 5:
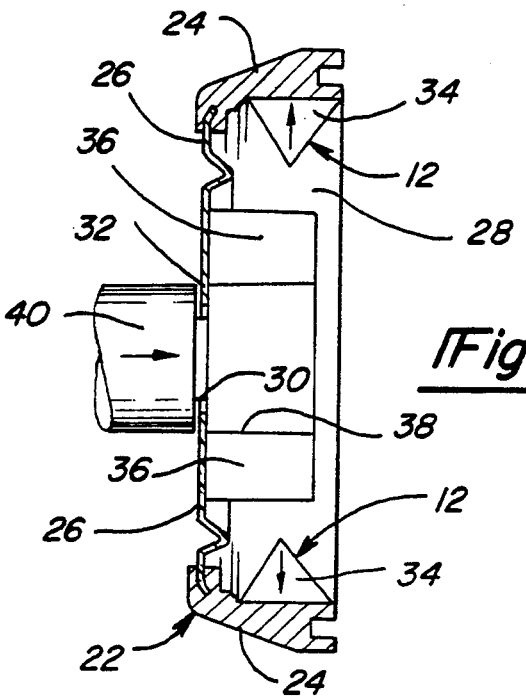
FIG. 5 is a diagrammatic view illustrating the gaging of a center of rotation relative to the braking surface of a brake drum according to the principles of the present invention.

As generally represented in FIG. 5, the gaging assembly 12 includes gage arms 34 which are synchronously moved outward to engage the braking surface 28 and establish an axis corresponding to the center of rotation of the braking surface 28. While only two gaging arms 34 are illustrated, it is important that three gage arms 34 are used. The three gage arms 34 are equidistantly spaced around the circumference of the braking surface 28 so as to geometrically establish a center or rotation with respect to the braking surface 28.

Once the gage arms 34 have established the center of rotation of the braking surface 28, a die 36 is brought into contact with one side of the face plate 26. The die 36 includes a cylindrical inner surface 38 having a diameter which corresponds in size that of desired mounting bore 32 which, in turn, corresponds to that portion of the vehicle axle assembly (not shown) to which the brake drum 22 is to be mounted.

After the position of the die 36 has been properly established, a punching tool 40 is applied to the opposing side of the face plate 26 so as to cut the new mounting bore 32 into the face plate 26. As an alternative to the use of the punching tool 40, the new mounting bore 32 can be created by other forming methods, including, but not limited to, boring, drilling and stamping.

As can be seen from the above discussion, the new mounting bore 32, and thus the brake drum 22 itself, will have a center or rotation which substantially corresponds to that of the braking surface 28. In this way, eccentricity between the center of rotation of the brake drum 22 and the center of rotation of the braking surface 28 is significantly eliminated or reduced.

Next, the brake drum 22 is mounted to the micro-finishing apparatus 10. The mounting assembly 14 is best illustrated in FIGS. 1–4. In positioning the unfinished brake drum 22 onto the micro-finishing apparatus 10, the new mounting bore 32 is inserted over a pilot 42. The pilot 42 is mounted within a cavity in a tailstock 44 and biased outwardly therefrom by a spring 46. The pilot also includes a tapered engagement surface 48 which coacts with the mounting bore 32 to locate and center the brake drum 22 on to the pilot 42. Being biased by the spring 46 allows the pilot 42 to accommodate brake drums 22 having mounting bores 32 of differing diameters when clamped against the tailstock 44 and having the tapered engagement surface 48 allows the pilot to readily center the brake drum 22. When properly positioned on the pilot 42, the center of rotation of the brake drum 22, the braking surface 28 and the mounting bore 32 will correspond with a rotational axis 50 extending through the pilot 42 and the tailstock 44 of the micro-finishing apparatus 10.

It has been found that various desirable characteristics can be more readily achieved if the brake drum 22 is micro-finished while loads are applied to the brake drum 22 so as to simulate those which would be incurred during actual use. For this reason, the mounting assembly 14 of the present invention can simulates those loads.

Figure 3:
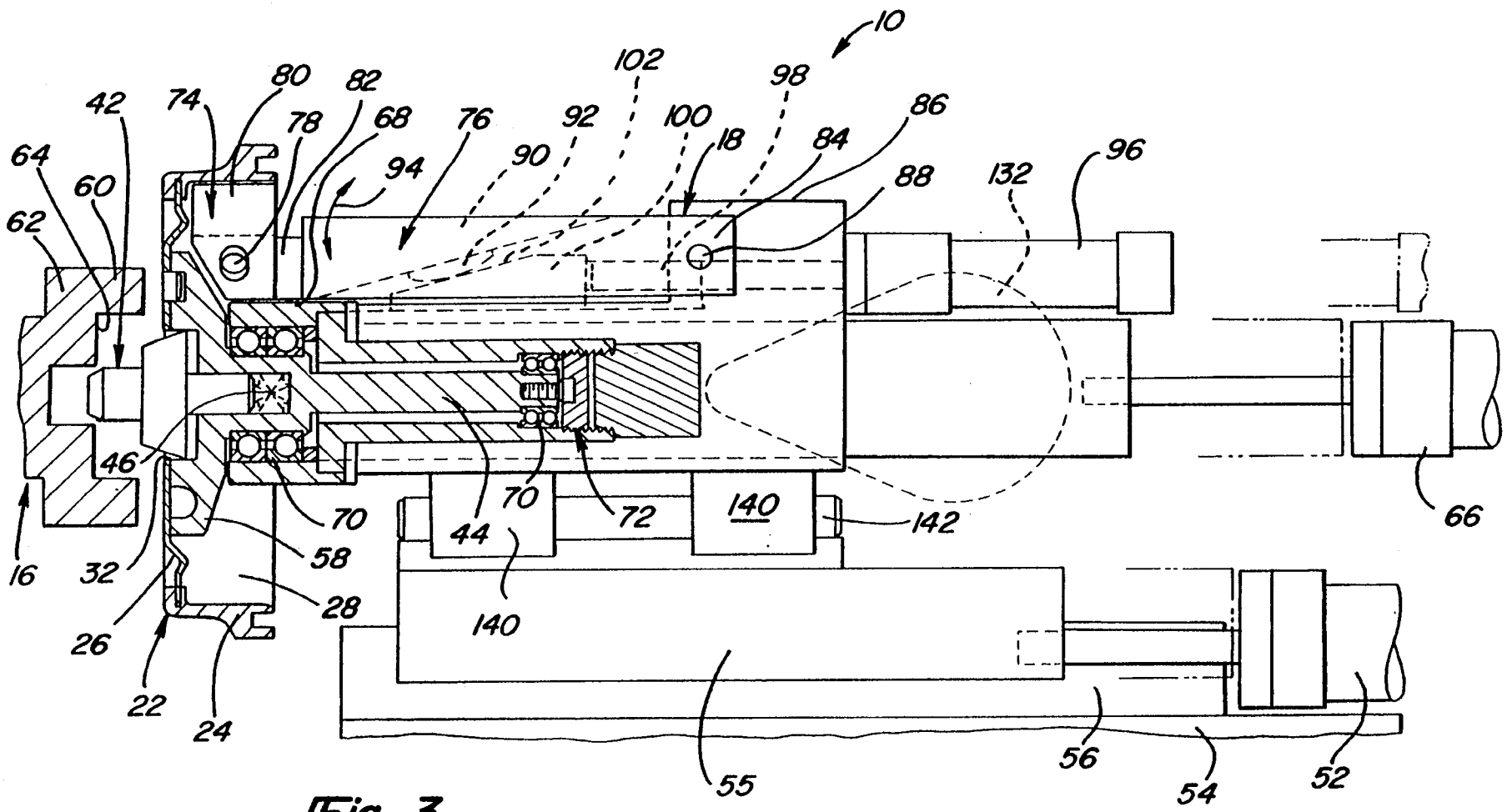
FIG. 3 is a longitudinal view with portions shown in cross-section of an apparatus for micro-finishing the braking surface of a brake drum according to the principles of the present invention.

In mounting the brake drum 22 with a force that corresponds to the normal loading experienced by the brake drum 22, an actuator or hydraulic cylinder 66 (hereinafter quill cylinder 66), mounted (not shown) to a base 54 of the micro-finishing apparatus 10, is actuated to axially move a quill 68 in which the tailstock 44 is journaled for rotation. This action clamps the face plate 26 of the brake drum 22 with an appropriate force between the tailstock 44 and a positive stop, headstock 62, being simultaneously applied from the opposing side of the brake drum 22. The headstock 62 also includes a recess 64 to accommodate that portion of the pilot 42 extending through the brake drum 22. As seen in FIG. 3, bearings 70 are provided within the quill 68 so as to rotationally support the tailstock 44. As generally designated at 72, a securement assembly of a type well known within the industry is also used to prevent inadvertent withdrawal of the tailstock 44 from the quill 68. The quill 68 itself is supported within a frame 86 of the shoe assembly 18 which is more fully discussed below.

The rotation assembly 16 includes a motor (not shown) which is used to rotationally drive the headstock 62, thereby inducing rotation of the brake drum 22, the tailstock 44 and the pilot 42. Once rotation of the brake drum 22 has been established, the shoe assembly 18 is actuated to begin micro-finishing of the braking surface 28.

Figure 4:
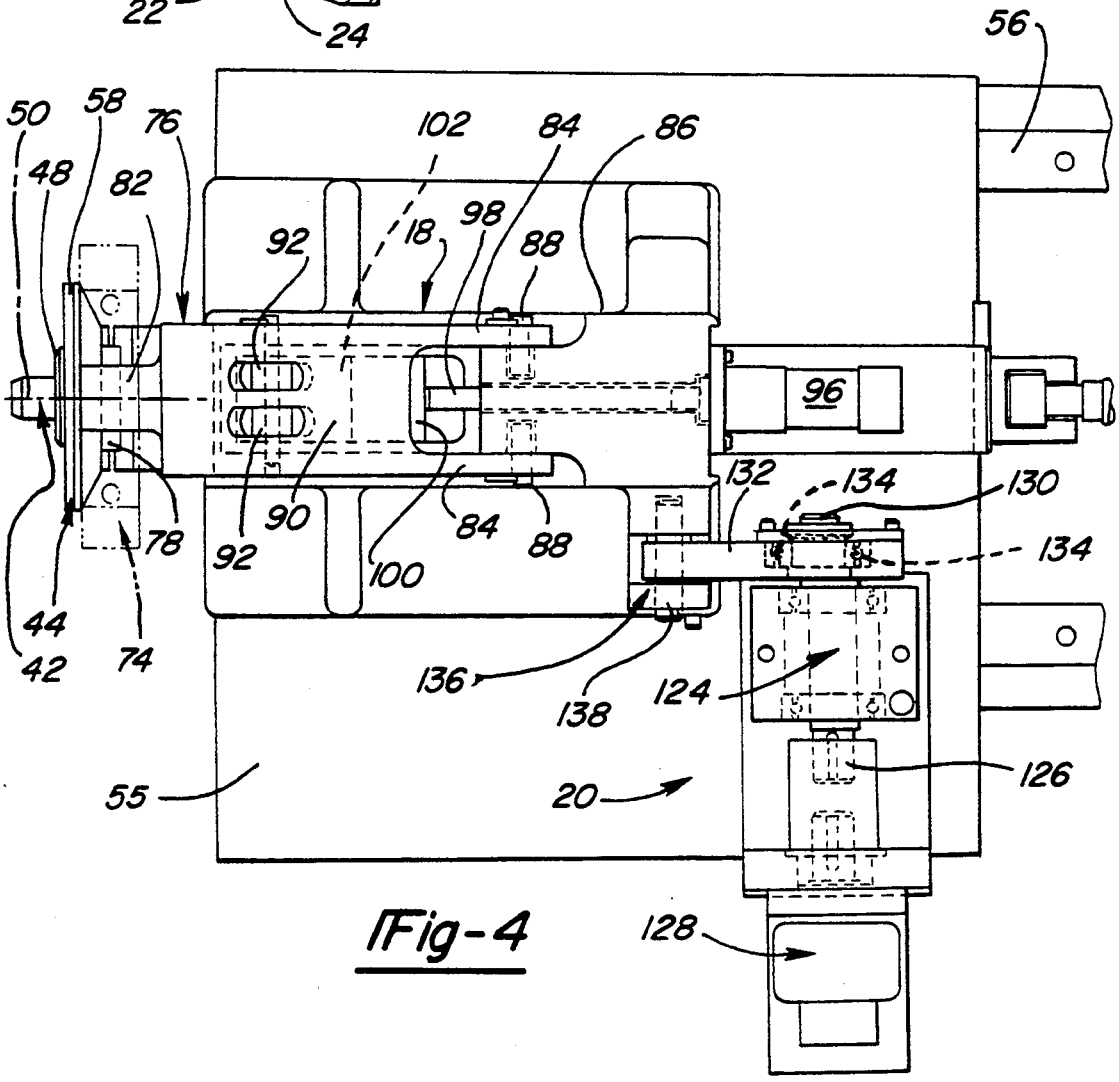
FIG. 4 is a plan view of the apparatus shown in FIG. 3 for micro-finishing brake drum braking surfaces according to the principles of the present invention.

Referring now to FIGS. 3 and 4, the shoe assembly 18 generally includes a polish shoe 74 which is pivotally mounted to a carrier arm 76 at opposing pivot points 78. The polish shoe 74 is pivotable about an axis which is generally perpendicular to the rotational axis 50 discussed above. The polish shoe 74 also has an arcuate engagement surface 80 which substantially corresponds in shape to that desired in the cylindrical braking surface 28 and therefore promotes increased roundness in the braking surface 28. Arcuate engagement surface 80 corresponds to an arcuate segment of at least 45° relative to the central axis of braking surface 20 and may be approximately 90° or 125°. The engagement surface 80 is constructed of a rigid and hard material which will not deform or give during the micro-finishing process.

The carrier arm 76 of the preferred embodiment has a yoke type construction. A stub 82, extending from one end of the carrier arm 76, provides a mount for the polish shoe 74 and a pair of pivot arms 84, extending oppositely therefrom, mount the carrier arm 76 to the frame 86 of the shoe assembly 18 at pivot points 88. Between the pivot arms 84 and the stub 82, the body 90 of the carrier arm exhibits a generally inverted wedge shape, which is best seen in FIG. 3. Centrally in the wedge shape body 90 are a pair of slides or rollers 92. As thus far described, it can be seen that the engagement surface 80 of the polish shoe 74 can be raised generally toward the braking surface 28 as the carrier arm 76 is pivoted about pivot points 88. The pivoting or rotational movement of the carrier arm 76 is generally illustrated by arrow 94. The pivotable mounting at 78 of the polish shoe 74 allows for the engagement surface 80 to flatly seat against the braking surface 28, substantially across its width, in response to the pivoting or rotation of the carrier arm 76. With the polish shoe 74 lying flat against the braking surface 28, a micro-finished braking surface 28 of decreased bore taper can be produced.

To affect movement of the carrier arm 76 and general engagement of the polish shoe 74 with the braking surface 28, an actuator or hydraulic cylinder 96 (hereinafter polish cylinder 96) is operated to advance a ram 98 having an upright wedge shaped driver 100 mounted to the forward most end thereof. The wedge driver 100 is advanced and engages the rollers 92 of the carrier arm 76. Further advancement of the wedge driver 100 causes the rollers 92 to move upward along a ramped surface 102 of the wedge driver 100, thereby upwardly rotating the carrier arm 76 and raising the polish shoe 74.

For the actual micro-finishing of the braking surface 28 of the brake drum 22, the present invention utilizes a tape or film 104 having an abrasive surface 106. The abrasive surface 106 of the film 104 can be formed from a variety of materials and, as such, the film 104 may be impregnated with diamonds, tungsten carbide, honing stones or other types of abrading materials.

The film 104 is routed from a supply roll 108, conveniently positioned within a holder 110 mounted to the micro-finishing apparatus 10, over the engagement surface 80 of the polishing shoe 74. To ensure proper routing of the film 104, a feed spindle 112, rotationally supported within a mounting bracket 114, receives the film 104 from the supply roll 108 and angularly aligns it with the engagement surface 80. The film 104 proceeds over the engagement surface 80 and is maintained in alignment therewith by the surface roughness of honing stones 116 positioned in the engagement surface 80. Alternatively, the honing stones 116 may be aligned and a roughened surface may be given to the engagement surface 80 of the polishing shoe 74 to hold the film 104 in position.

At the opposing end of the engagement surface 80, the film 104 passes over a take-up spindle 118, rotatably held in a mounting bracket 120, which routes the tape 104 away from the micro-finishing apparatus 10 to a discarding or waste area.

During micro-finishing of the brake drum 22, the brake drum 22 is rotated as discussed above and the polishing shoe 74 is raised by the carrier arm 74 and wedge driver 100 to cause abrasive contact between the abrasive surface 106 of the film 104 and the braking surface 28. As the brake drum 22 is rotated, the film 104 is advanced by a feed mechanism (not shown) across the engagement surface 108 of the polish shoe 74. Thus, a clean or fresh abrasive surface 106 is used to micro-finish the braking surface 28.

To further enhance the micro-finish produced by the micro-finishing apparatus 10 of the present invention, the shoe assembly 18, including the polishing shoe 74 and the film 104, is axially oscillated along the rotational axis 50. To produce this oscillation, the oscillation assembly 20 mentioned above is coupled to the shoe assembly 18. The oscillation assembly 20 is illustrated in FIG. 4.

The primary working member of the oscillation assembly 122 is an eccentric shaft 124 of which a first end 126 is connected to an oscillating motor, generally designated at 128. The oscillating motor 128 can be of numerous variety, however, a hydraulic motor is preferred. A second end 130 of the eccentric shaft 124 is rotationally journaled in one end of a linkage 132 by bearings 134. The linkage is connected at its opposing end to a mounting portion 136 of the shoe assembly frame 86 by a pivotal connection 138. The frame 86 itself is supported and carried by oscillation slide members 140 which are mounted for axial movement along rails 142 of the main slide 55.

During operation of the oscillation assembly 20, rotation of the first end 126 of the eccentric shaft 124 will induce the eccentric rotation of the second end 130 and an orbital movement in one end of the linkage 132. By rotationally journaling the second end 130 of the eccentric shaft 124 in and pivotally connecting 138 of the other end of the linkage 132 to the frame 86, the eccentric rotation is transformed into axial movement of the frame 86 and the shoe assembly 18. The axial movement particularly shows up as the sliding of the oscillation slide members 140, along the rails 142 and an axis being generally parallel to the rotational axis 50. The oscillatory movement of the shoe assembly 18 created by the oscillation assembly 20 thus results in axial movement of the abrasive film 104, and the polish shoe 74, relative to the braking surface 28. Relative movement between the film 104 and the polish shoe 74 is inhibited because of the roughened surface of the honing stone 116 of the shoe 74. The oscillatory movement is beneficial since it ensures that a straight braking surface 28 will be promoted. It is anticipated that oscillatory movement need not be of a great magnitude and that an oscillation of one eight of an inch will suffice.

In view of the above description of the micro-finishing apparatus 10, the method of the present invention for micro-finishing the braking surface 28 of a brake drum 22 can be summarized as follows:

a) gaging a center of rotation for a brake drum off of a braking surface of the brake drum;

b) forming a mounting bore in the brake drum which is concentric with the center of rotation of the braking surface;

c) locating the mounting bore of the brake drum on the micro-finishing apparatus so that the rotational axis of the micro-finishing apparatus will correspond with the center of rotation of the braking surface;

d) securing the brake drum on the micro-finishing apparatus;

e) simulating the actual mounting forces experienced by a brake drum when mounted for actual use;

f) rotating the brake drum;

g) positioning an abrasive film over a finishing tool; and h) urging the abrasive film into contact with the braking surface of the brake drum to micro-finish the braking surface.

While the above description constitutes the preferred embodiment of the present invention, it will be appreciated that the invention is susceptible to modification, variation and change without departing from the proper scope and fair meaning of the accompanying claims.

What is claimed is:

1. An apparatus for micro-finishing an inside cylindrical brake drum braking surface, said braking surface defining a central longitudinal axis, said apparatus comprising:

a shoe having an engagement surface, said engagement surface having a semi-cylindrical shape substantially corresponding to a portion of said braking surface;

a supply of micro-finishing film, said film having an abrasive surface formed on at least one side thereof;

means for routing said film over said shoe engagement surface with said abrasive surface being positioned opposite and facing away from said engagement surface;

mounting means for mounting said brake drum to said apparatus about an axis of rotation, locating means for coaxially positioning said axis of rotation and said braking surface longitudinal axis;

means for rotating said brake drum about said axis of rotation;

means for urging said abrasive surface into surface-to-surface contact with said braking surface during rotation of said brake drum; and oscillation means for axially oscillating said shoe and said film across said braking surface in a direction along an axis substantially parallel to said braking surface longitudinal axis and to said axis of rotation while said brake drum is rotated.

2. An apparatus as set forth in claim 1 wherein said means for urging includes a frame, a carrier arm and first actuation means, said carrier arm being movably mounted to said frame and mounting said shoe, said actuation means being operable for moving said carrier arm and thereby urging said film abrasive surface into surface-to-surface contact with said braking surface.

3. An apparatus as set forth in claim 2 wherein said carrier arm is pivotally mounted to said frame.

4. An apparatus as set forth in claim 2 wherein said carrier arm includes a body portion, coupled to said first actuation means.

5. An apparatus as set forth in claim 4 wherein said first actuation means includes a driver and being engagable with said body portion.

6. An apparatus as set forth in claim 5 wherein said driver is generally wedge shaped.

7. An apparatus as set forth in claim 5 wherein said body portion includes an engagement member and being engagable by said driver.

8. An apparatus as set forth in claim 7 wherein said driver includes an engagement surface being engagable with said engagement member.

9. An apparatus as set forth in claim 8 wherein said engagement surface is a ramped surface.

10. An apparatus as set forth in claim 2 wherein said first actuation means is a hydraulic cylinder.

11. An apparatus as set forth in claim 1 wherein said tool is rigid.

12. An apparatus as set forth in claim 1 wherein said shoe engagement surface of said tool is rigid.

13. An apparatus as set forth in claim 1 wherein said engagement surface substantially corresponds to an arcuate segment of at least forty-five degrees relative to said central axis of said braking surface.

14. An apparatus as set forth in claim 1 wherein said engagement surface substantially corresponds to an arcuate segment of at least ninety degrees relative to said central axis of said braking surface.

15. An apparatus as set forth in claim 1 wherein said engagement surface approximately corresponds to an arcuate segment of one hundred twenty-five degrees relative to said central axis of said braking surface.

16. An apparatus as set forth in claim 1 further comprising means for advancing said film across said engagement surface.

17. An apparatus for micro-finishing an inside cylindrical brake drum braking surface, said braking surface defining a central longitudinal axis, said apparatus comprising:

a shoe having an engagement surface, said engagement surface having a semi-cylindrical shape substantially corresponding to a portion of said braking surface;

a supply of micro-finishing film, said film having an abrasive surface formed on at least one side thereof;

means for routing said film over said shoe engagement surface with said abrasive surface being positioned opposite and facing away from said engagement surface;

mounting means for mounting said brake drum to said apparatus about an axis of rotation, locating means for coaxially positioning said axis of rotation and said braking surface longitudinal axis;

means for rotating said brake drum about said axis of rotation;

means for urging said abrasive surface into surface-to-surface contact with said braking surface during rotation of said brake drum, said urging means including a frame, a carrier arm and first actuation means, said carrier arm being movably mounted to said frame and said shoe being pivotally mounted to said carrier arm, said actuation means being operable for moving said carrier arm and thereby urging said abrasive surface into surface-to-surface contact with said braking surface; and oscillation means for reciprocating said shoe in the direction of said axis of rotation while said brake drum is rotated.

18. An apparatus as set forth in claim 17 wherein said shoe is pivotable about a pivot axis being generally perpendicular to said axis of rotation.

19. An apparatus for micro-finishing an inside cylindrical brake drum braking surface, said braking surface defining a central longitudinal axis, said apparatus comprising:

a shoe having an engagement surface, said engagement surface having a semi-cylindrical shape substantially corresponding to a portion of said braking surface;

a supply of micro-finishing film, said film having an abrasive surface formed on at least one side thereof;

means for routing said film over said shoe engagement surface with said abrasive surface being positioned opposite and facing away from said engagement surface;

mounting means for mounting said brake drum to said apparatus about an axis of rotation, locating means for coaxially positioning said axis of rotation and said braking surface longitudinal axis, said locating means including a pilot having a tapered surface for engaging a mounting bore of said brake drum;

means for rotating said brake drum about said axis of rotation;

means for urging said abrasive surface into surface-to-surface contact with said braking surface during rotation of said brake drum; and oscillating means for reciprocating said shoe in the direction of said axis of rotation while said brake drum is rotated.

20. An apparatus as set forth in claim 19 wherein said pilot is generally axially movable.

21. An apparatus as set forth in claim 20 wherein said pilot is biased toward engagement with said mounting bore of said brake drum by a biasing member.

22. An apparatus as set forth in claim 21 wherein said biasing member is a spring.

23. An apparatus for micro-finishing an inside cylindrical brake drum braking surface, said braking surface defining a central longitudinal axis, said apparatus comprising:

a shoe having an engagement surface, said engagement surface having a semi-cylindrical shape substantially corresponding to a portion of said braking surface;

a supply of micro-finishing film, said film having an abrasive surface formed on at least one side thereof;

means for routing said film over said shoe engagement surface with said abrasive surface being positioned opposite and facing away from said engagement surface;

mounting means for mounting said brake drum to said apparatus about an axis of rotation, said mounting means including means for simulating mounting forces being applied during mounting of said brake drum to a vehicle;

locating means for coaxially positioning said axis of rotation and said braking surface longitudinal axis;

means for rotating said brake drum about said axis of rotation;

means for urging said abrasive surface into surface-to-surface contact with said braking surface during rotation of said brake drum; and oscillation means for reciprocating said shoe in the direction of said axis of rotation while said brake drum is rotated.

24. An apparatus as set forth in claim 23 wherein said simulating means includes a second actuation means, a headstock, a quill and a tailstock, said tailstock being rotatably supported in said quill, said second actuation means for moving said quill and said tailstock to a position clamping said brake drum between said tailstock and said headstock.

25. An apparatus as set forth in claim 24 wherein said rotation means is connected to said headstock for rotating said headstock.

26. An apparatus as set forth in claim 24 wherein said second actuation means is a hydraulic cylinder.

27. An apparatus as set forth in claim 24 wherein said locating means is mounted to said tailstock.

28. An apparatus as set forth in claim 27 said locating means includes a pilot having a tapered surface for engaging a mounting bore of said brake drum.

29. An apparatus as set forth in claim 28 wherein said pilot is generally axially movable.

30. An apparatus as set forth in claim 29 wherein said pilot is biased by a biasing member toward engagement with said mounting bore of said brake drum.

31. An apparatus as set forth in claim 30 wherein said biasing member is a spring.

32. An apparatus for micro-finishing an inside cylindrical brake drum braking surface, said braking surface defining a central longitudinal axis, said apparatus comprising:

a shoe having an engagement surface, said engagement surface having a semi-cylindrical shape substantially corresponding to a portion of said braking surface;

a supply of micro-finishing film, said film having an abrasive surface formed on at least one side thereof;

means for routing said film over said shoe engagement surface with said abrasive surface being positioned opposite and facing away from said engagement surface;

mounting means for mounting said brake drum to said apparatus about an axis of rotation, locating means for coaxially positioning said axis of rotation and said braking surface longitudinal axis;

means for rotating said brake drum about said axis of rotation;

means for urging said abrasive surface into surface-to-surface contact with said braking surface during rotation of said brake drum; and oscillation means for reciprocating said shoe in the direction of said axis of rotation while said brake drum is rotated, said oscillation means including a frame generally supporting said tool, said frame being mounted on a support for relative movement therewith, said oscillating means further including motor means and an eccentric shaft having first and second ends, said first end being coupled to said motor means for imparting rotation to said eccentric shaft, linkage means for coupling said second end of said eccentric shaft to said frame.

33. An apparatus as set forth in claim 32 wherein said second end is rotationally coupled to a first portion of said linkage means.

34. An apparatus as set forth in claim 33 wherein said linkage means includes a second portion being pivotally mounted to said frame, whereby rotation of said first end of said eccentric shaft produces an eccentric rotation of said second end and an orbital movement of said first portion of said linkage means, said orbital movement of said first portion of said linkage means producing generally oscillatory axial movement of said second portion and said frame.

* * * * *